US008186844B2

(12) United States Patent
Hall

(10) Patent No.: US 8,186,844 B2
(45) Date of Patent: May 29, 2012

(54) FRONT-TO-BACK SHOWCASE LIGHTING FOR A REFRIGERATOR

(75) Inventor: David L. Hall, Piedmont, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 356 days.

(21) Appl. No.: 12/394,386

(22) Filed: Feb. 27, 2009

(65) Prior Publication Data

US 2010/0220460 A1 Sep. 2, 2010

(51) Int. Cl.

| | |
|---|---|
| ***F21V 33/00*** | (2006.01) |
| ***F25D 27/00*** | (2006.01) |
| ***F25D 23/00*** | (2006.01) |
| ***F27D 21/02*** | (2006.01) |
| ***A47B 23/06*** | (2006.01) |
| ***A47B 96/04*** | (2006.01) |

(52) U.S. Cl. ..... 362/127; 362/92; 220/592.02; 62/3.6; 312/401

(58) Field of Classification Search ..... 362/92–94; 62/264, 3.6; 312/401, 406–407.1; 220/592.02
See application file for complete search history.

(56) References Cited

U.S. PATENT DOCUMENTS

| | | | | |
|---|---|---|---|---|
| 5,836,669 | A | 11/1998 | Hed | |
| 6,478,445 | B1 * | 11/2002 | Lange et al. | 362/223 |
| 6,726,341 | B2 | 4/2004 | Pashley et al. | |
| 6,877,329 | B2 | 4/2005 | Bassi | |
| 6,904,764 | B2 | 6/2005 | Bassi | |
| 7,096,678 | B2 | 8/2006 | Petroski | |
| 7,121,675 | B2 | 10/2006 | Ter-Hovhannisian | |
| 7,588,340 | B2 * | 9/2009 | Bauer et al. | 362/92 |
| 7,736,010 | B2 * | 6/2010 | Lee | 362/92 |
| 2004/0246716 | A1 | 12/2004 | Hubert et al. | |
| 2006/0138916 | A1 | 6/2006 | Kordon | |
| 2006/0201181 | A1 | 9/2006 | Bauer et al. | |
| 2007/0104841 | A1 | 5/2007 | Min et al. | |

(Continued)

FOREIGN PATENT DOCUMENTS

| | | | |
|---|---|---|---|
| AU | 2005203137 | | 3/2006 |
| DE | 29814243 | U1 | 11/1998 |

(Continued)

OTHER PUBLICATIONS

International Search Report for PCT/US2010/024708, Nov. 11, 2010, dated 3 pages.

*Primary Examiner* — Jong-Suk (James) Lee
*Assistant Examiner* — David J Makiya
(74) *Attorney, Agent, or Firm* — Pearne & Gordon LLP

(57) ABSTRACT

A refrigeration appliance includes an appliance housing and a liner within the housing, defining an interior storage chamber at least partially enclosed by the liner, and providing a storage chamber rear wall, a first storage chamber sidewall, and a second storage chamber sidewall. The first storage chamber sidewall has a plurality of openings through the first storage chamber sidewall. The second storage chamber sidewall has another plurality of openings through the second storage chamber sidewall. A plurality of lighting devices illuminates the interior storage chamber. Each of the lighting devices is mounted within a respective one of the openings and emits light toward the storage chamber rear wall providing a showcase lighting effect. Each of the lighting devices includes a cover located in the interior storage chamber and a device housing located within the respective one of the openings. An illumination level within the storage chamber, due to light emitted by the plurality of lighting devices, is substantially vertically uniform.

14 Claims, 5 Drawing Sheets

U.S. PATENT DOCUMENTS

| | | | | |
|---|---|---|---|---|
| 2007/0127229 | A1* | 6/2007 | Lee et al. | 362/92 |
| 2007/0159820 | A1* | 7/2007 | Crandell et al. | 362/249 |
| 2008/0037239 | A1* | 2/2008 | Thomas et al. | 362/92 |
| 2008/0247154 | A1* | 10/2008 | Lim et al. | 362/92 |
| 2009/0310362 | A1* | 12/2009 | Weij | 362/249.02 |
| 2010/0097780 | A1* | 4/2010 | Beatenbough et al. | 362/92 |

FOREIGN PATENT DOCUMENTS

| | | |
|---|---|---|
| EP | 1076215 | 2/2001 |
| EP | 1431689 | 6/2004 |
| EP | 1876389 | 1/2008 |
| JP | 2008070080 | 3/2008 |
| WO | 2008056910 | 5/2008 |

* cited by examiner

FRONT-TO-BACK SHOWCASE LIGHTING FOR A REFRIGERATOR

BACKGROUND OF THE INVENTION

1. Field of the Invention

The present invention relates to lighting systems for domestic appliances, and more particularly to front-to-back showcase lighting systems for domestic refrigerators.

2. Description of Related

It is known to illuminate the food storage chamber of a domestic refrigerator when an access door to the chamber is opened. The food storage chamber is typically illuminated by a light source, such as an incandescent bulb, located within the food storage chamber toward its rear. The light source takes up space within the food storage chamber that could otherwise be used for food storage and provides non-uniform lighting within the chamber.

BRIEF SUMMARY OF THE INVENTION

In accordance with one aspect of the present invention, provided is a refrigeration appliance that includes an appliance housing and a liner within the appliance housing, defining an interior storage chamber at least partially enclosed by the liner, and providing a storage chamber rear wall, a first storage chamber sidewall, and a second storage chamber sidewall. The first storage chamber sidewall has a plurality of openings through the first storage chamber sidewall. The second storage chamber sidewall has another plurality of openings through the second storage chamber sidewall. A plurality of lighting devices illuminates the interior storage chamber. Each of the lighting devices is mounted within a respective one of the openings and emits light toward the storage chamber rear wall providing a showcase lighting effect, and each of the lighting devices includes a cover located in the interior storage chamber and a device housing located within the respective one of the openings. An illumination level within the storage chamber, due to light emitted by the plurality of lighting devices, is substantially vertically uniform.

In accordance with another aspect of the present invention, provided is a refrigeration appliance that includes an appliance housing and a liner within the appliance housing, at least partially enclosing a fresh food storage chamber, and providing a rear wall, a first sidewall having a plurality of openings in a surface of the first sidewall, and a second sidewall having a plurality of openings in a surface of the second sidewall. A plurality of light-emitting diode light fixtures emits light toward the rear wall providing a showcase lighting effect. Each of the light-emitting diode light fixtures includes a fixture housing located within a respective one of the openings and a cover covering at least a portion of the respective one of the openings. An illumination level within the fresh food storage chamber, due to the light emitted by the plurality of light-emitting diode light fixtures, is substantially vertically uniform.

DETAILED DESCRIPTION OF THE INVENTION

Figure 1:
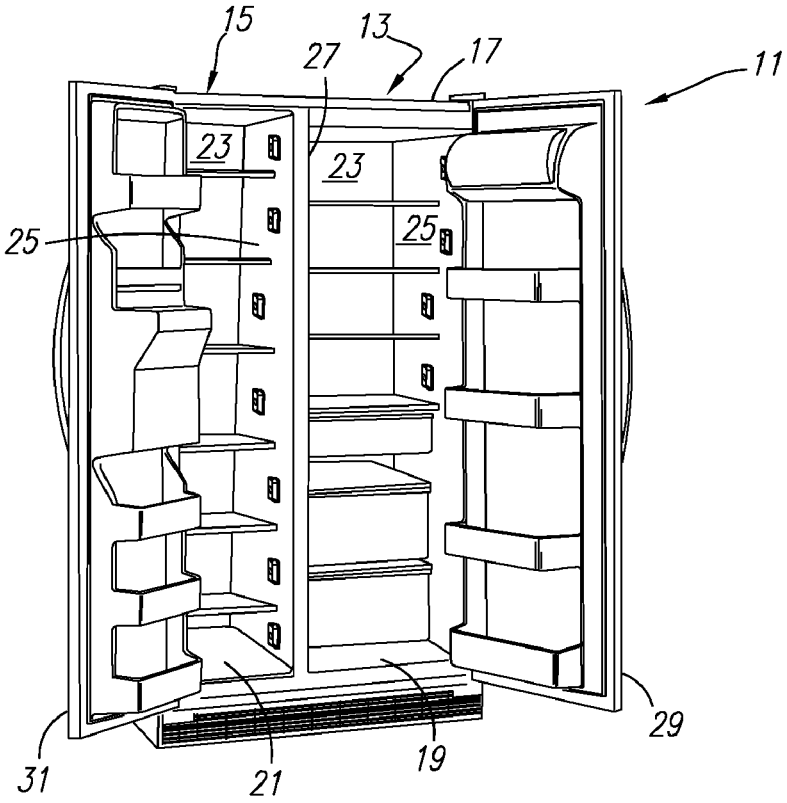
FIG. 1 is a perspective view of a refrigeration appliance.

The present invention relates to lighting systems for domestic appliances, and particularly to front-to-back showcase lighting systems for domestic refrigerators. The present invention will now be described with reference to the drawings, wherein like reference numerals are used to refer to like elements throughout. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

FIG. 1 shows a domestic refrigeration appliance 11. The refrigeration appliance 11 can include one or both of a fresh food storage chamber 13 and a freezer storage chamber 15. The refrigeration appliance 11 has an outer appliance housing 17 and one or more inner liners 19, 21. In FIG. 1, the inner liners 19, 21 respectively partially enclose and define the fresh food storage chamber 13 and the freezer storage chamber 15. The inner liners 19, 21 each provide a rear wall 23, a first sidewall 25 and a second sidewall 27 for their respective storage chambers. Foamed-in insulation (not shown) is located between the appliance housing 17 and the inner liners 19, 21. A refrigeration circuit (not shown) cools the storage chambers 13, 15. When in an open position, movable closures, such as hinged doors 29, 31, provide user access to the storage chambers 13, 15 through respective access openings. The movable closures close off the access openings when in a closed position.

Figure 2:
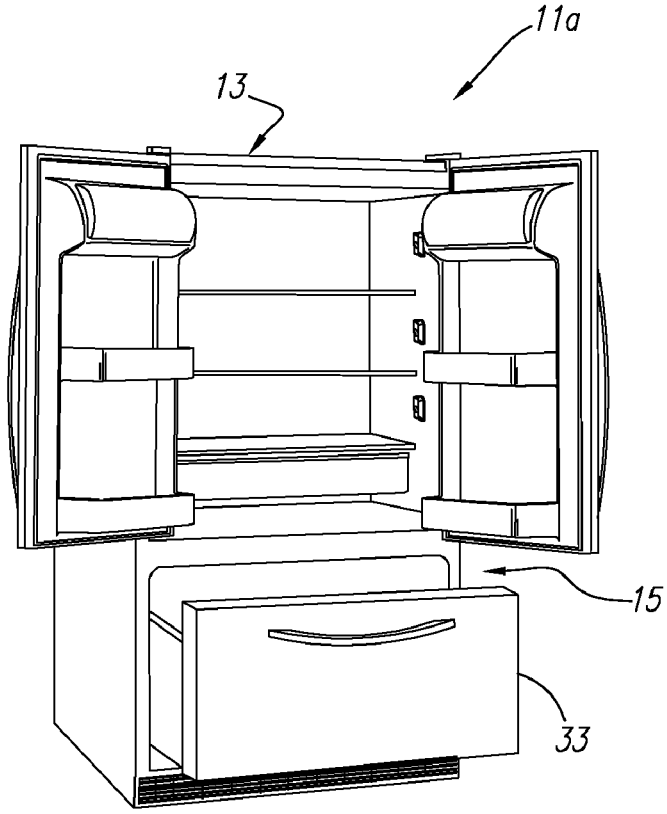
FIG. 2 is a perspective view of a refrigeration appliance.

The refrigeration appliance 11 of FIG. 1 is a side-by-side type refrigerator/freezer, which places the freezer storage chamber 15 next to the fresh food storage chamber 13. An alternative bottom-mount refrigerator/freezer 11*a* is shown in FIG. 2. In the bottom-mount refrigerator/freezer 11*a*, the freezer storage chamber 15 is located beneath the fresh food storage chamber 13. A pull-out drawer 33 having a storage basket can provide access to the freezer storage chamber 15. A still further alternative configuration is the top-mount refrigerator/freezer (not shown), which places the freezer storage chamber 15 above the fresh food storage chamber 13. The lighting systems discussed in detail below are applicable to any of the side-by-side, bottom-mount or top-mount refrigerator/freezers.

Figure 3:
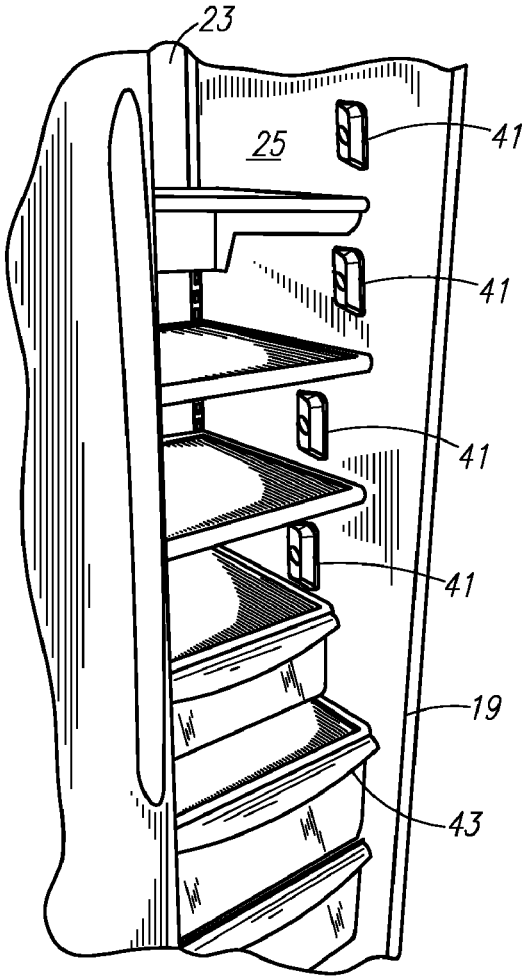
FIG. 3 is a partial perspective view of a refrigeration appliance.
Figure 4:
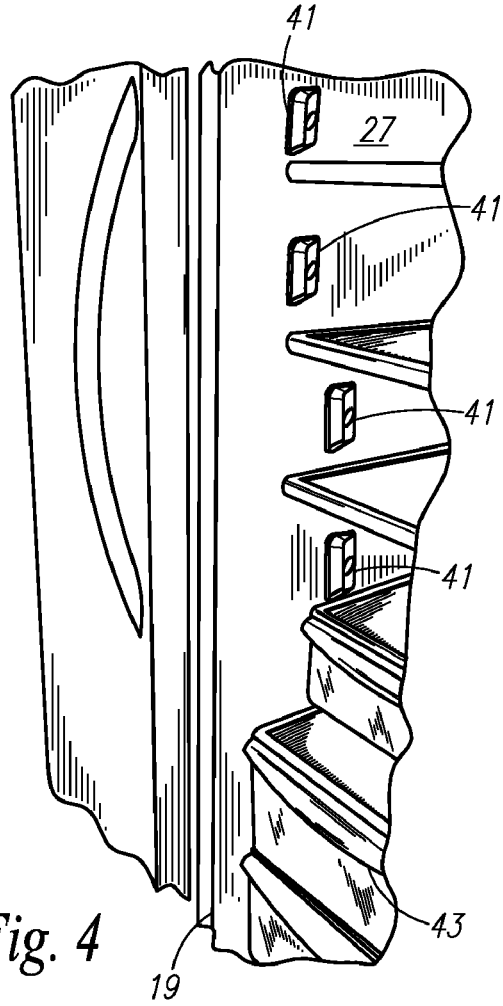
FIG. 4 is a partial perspective view of a refrigeration appliance.
Figure 10:
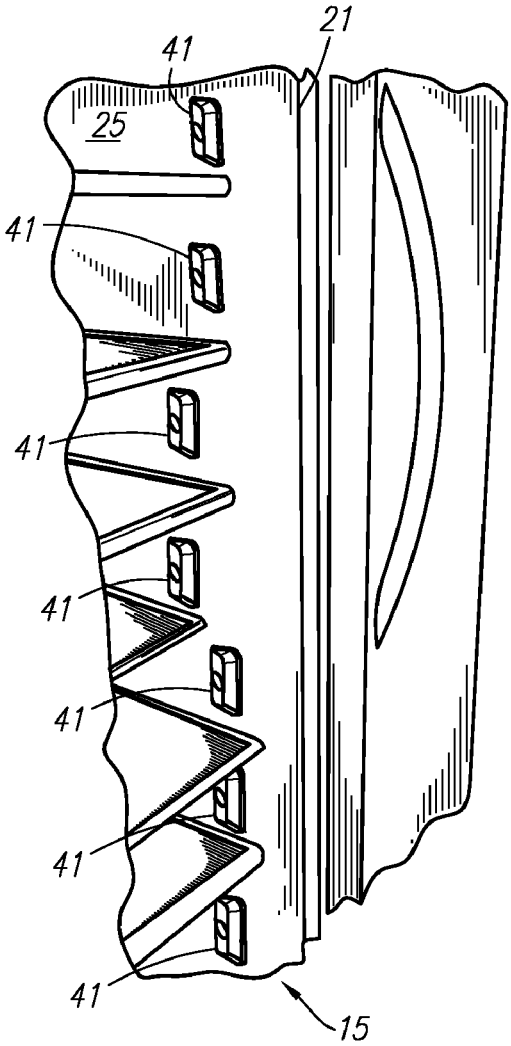
FIG. 10 is a partial perspective view of a refrigeration appliance.
Figure 11:
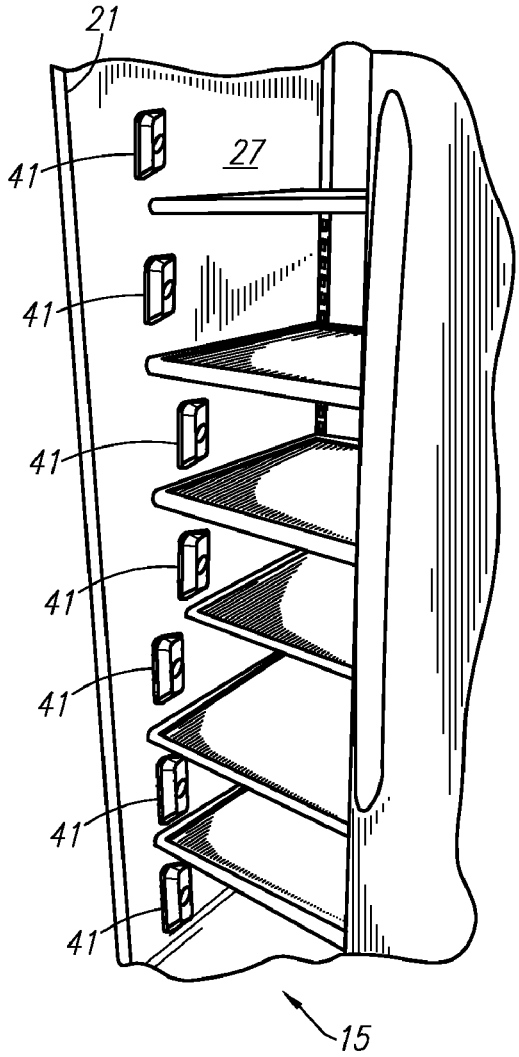
FIG. 11 is a partial perspective view of a refrigeration appliance.

Turning to FIGS. 3 and 4, detailed views of portions of the inner liner 19 for the fresh food storage chamber 13 are shown. A plurality of lighting devices 41 are shown mounted to the sidewalls 25, 27 of the inner liner 19. The lighting devices 41 illuminate the fresh food storage chamber 13 when the door 29 (see FIG. 1) is opened. The lighting devices 41 emit light rearward, toward the rear wall 23 of the liner 19, in a front-to-back manner. Therefore, the lighting devices 41 provide a showcase lighting effect by illuminating the fresh food storage chamber 13 and any stored food items located therein in a front-to-back manner. Similarly configured lighting devices can be provided on the inner liner 21 of the freezer storage chamber 15 as shown in FIGS. 10 and 11 (discussed below). Because the lighting devices 41 direct light toward the rear wall of the food storage chamber, the light fixtures can be located toward the front of the appliance, closer to the hinged doors 29, 31 (see FIG. 1) and access openings than to the rear walls 23 of the liners 19, 21.

The lighting devices 41 are mounted in openings in the liner's surface that can be openings or apertures though the liner 19 or in recesses or depressions formed by the liner. Therefore, the lighting devices 41 occupy a very limited space within the storage chamber formed by the liner 19.

The lighting devices 41 can be positioned along the liner 19, oriented, and/or have optical elements (e.g., diffusers, reflectors, lenses, etc.) such that an illumination level within the fresh food storage chamber 13 is substantially vertically uniform. For example, with the storage shelves, drawers, etc. removed from the fresh food storage chamber 13, or alternatively left in place, lighting level measurements taken at various vertical positions at a particular common horizontal position would show substantial lighting level uniformity at the various vertical positions. An example location at which the illumination level can be substantially vertically uniform is along a vertical axis adjacent to the rear wall 23 of the liner 19. Another example location is along a vertical axis through the center of the food storage chamber.

It is to be appreciated that the separate lighting devices 41 within a storage chamber 13, 15 can be positioned and configured to provide a showcase lighting effect and simultaneously a substantially vertically uniform lighting effect in said chamber 13, 15. Further, because the separate lighting devices 41 are recessed in openings in the liners 19, 21, the substantially vertically uniform showcase lighting effect can be provided while maintaining available storage space within said chamber 13, 15.

In an embodiment, some or all of the lighting devices 41 are vertically aligned with each other on a given sidewall 25, 27 within the fresh food 13 or freezer 15 storage chambers. Further, the optical elements of the lighting devices 41 can be configured to direct the emitted light along a desired path within the fresh food 13 or freezer storage chamber 15. Lighting devices 41 can be next to storage bins 43 (e.g., a crisper drawer) within a food storage chamber to direct light into the storage bins.

In an embodiment, the illumination level within the fresh food 13 or freezer storage chamber 15 is substantially vertically uniform and also within the range of 600-1200 lux. For example, the lighting level measurements taken at various vertical positions at a particular common horizontal position would all substantially equal 600 lux, or some other intensity within the range of 600-1200 lux.

In an embodiment, the lighting devices 41 illuminate the fresh food 13 or freezer storage chamber 15 with light having a desired color temperature. For example, the lighting devices 41 can illuminate the storage chambers 13, 15 with a color temperature within the range of 4000 to 5500 K, or other color temperatures as desired.

The lighting devices 41 can be light-emitting diode (LED) light fixtures having one or more LEDs for illuminating the fresh food 13 and/or freezer 15 storage chamber. The lighting devices 41 can comprise light emitting elements other than LEDs, such as incandescent bulbs for example. In an embodiment, the lighting devices 41 discharge light that is generated by a fiber optic illuminator (not shown) and transmitted to the lighting devices via optical fibers.

Figure 5:
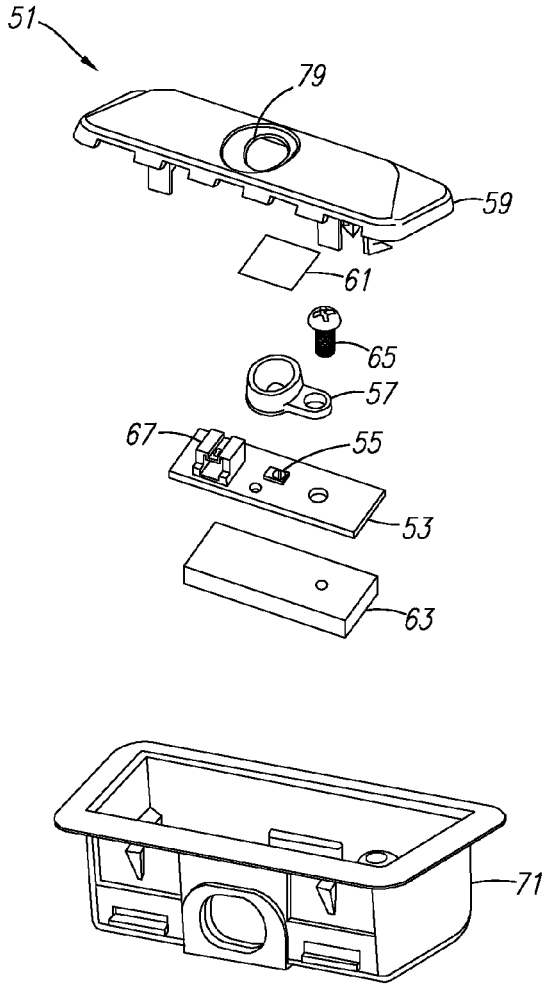
FIG. 5 is an exploded view of a light fixture.
Figure 6:
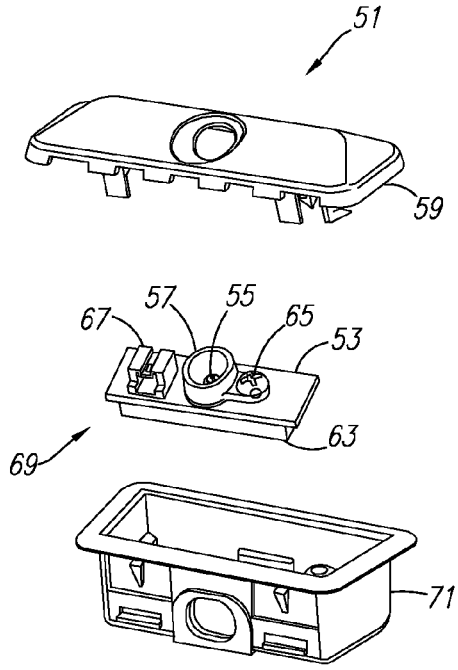
FIG. 6 is an exploded view of a light fixture.

An example LED light fixture 51 is shown in FIGS. 5 and 6. The light fixture 51 includes a printed circuit board 53 having at least one LED 55. A reflector 57 is attached to the printed circuit board 53 for directing light emitted by the LED through a light fixture cover 59 and an optional lens 61. The lens 61 can be transparent or translucent. A heat sink 63 is attached to the printed circuit board 53. The heat sink 63, printed circuit board 53 and reflector 57 can be attached together via a screw 65 or other fastener. An electrical connector 67 can be provided on the printed circuit board 53 for attaching the printed circuit board to a source of electrical power and/or control signals. The printed circuit board 53 and heat sink 63 assembly 69 can be located within a fixture or device housing 71, to which the cover 59 is removably attachable.

Figure 7:
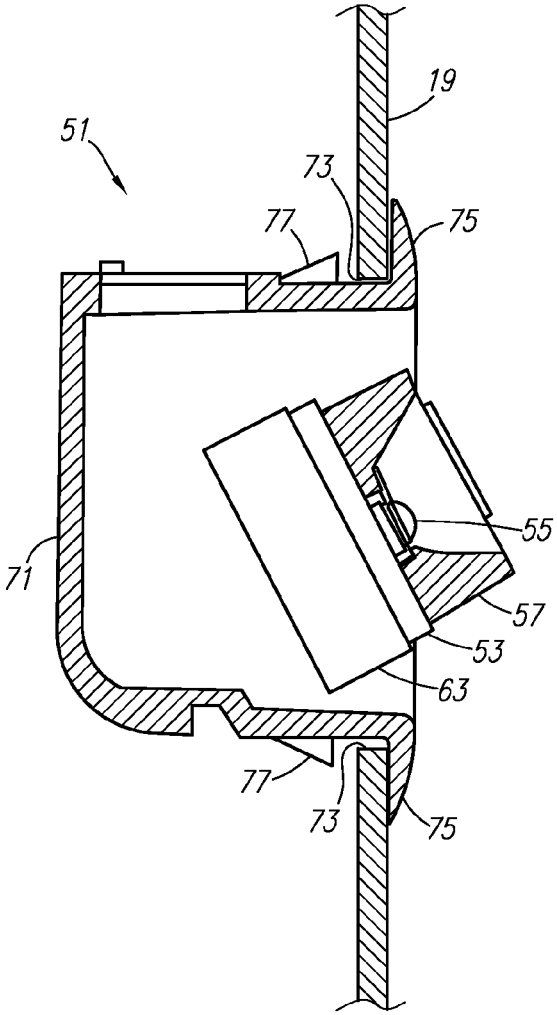
FIG. 7 is partial plan view of a refrigeration appliance and light fixture.

FIG. 7 provides a partial plan view of a liner, such as the fresh food storage chamber liner 19, and the LED light fixture 51. The housing 71 of the LED light fixture 51 is located in an opening in the liner's surface, such as an opening or aperture 73 through the liner 19. Alternatively, the housing 71 can be mounted in a recess or depression formed in the surface of the liner. A perimeter lip 75 of the housing 71 and a tab 77 retain the housing within the opening or aperture 73. The housing 71 can be further secured to the liner 19, such as by gluing or via fasteners.

The light fixture cover 59 is not shown in FIG. 7. However, it is to be appreciated that light emitted by the LED 55 would pass through the cover 59, such as through an opening 79 in the cover (see FIG. 5), and toward the rear wall of the food storage chamber.

Figure 8:
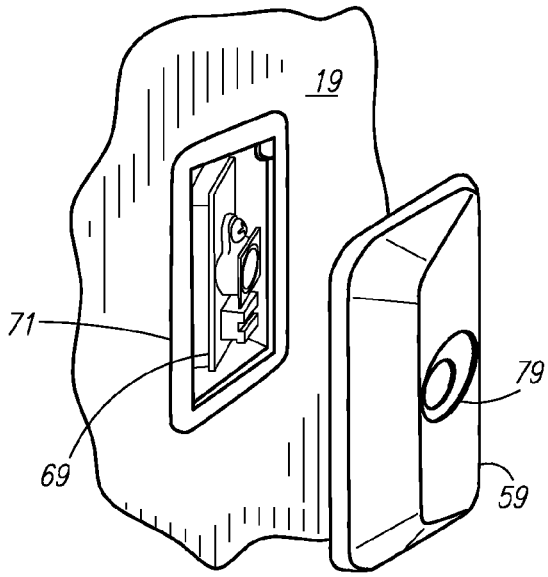
FIG. 8 is partial perspective view of a refrigeration appliance and light fixture.
Figure 9:
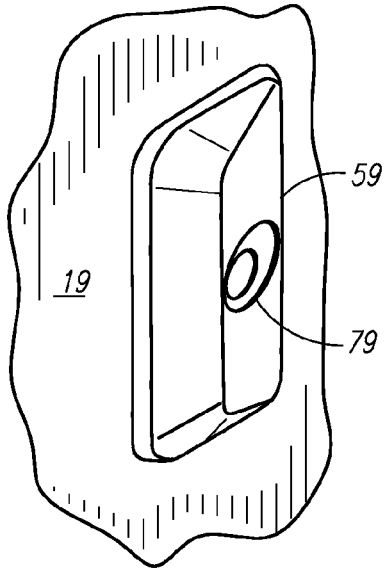
FIG. 9 is a partial perspective view of a refrigeration appliance and light fixture.

FIGS. 8 and 9 provide a partial perspective view of a liner, such as the fresh food storage chamber liner 19, and the LED light fixture. In FIG. 8, the cover 59 is shown detached from the LED light fixture. It can be seen that the printed circuit board and heat sink assembly 69 is angled within the housing 71, to direct light toward the rear wall of the food storage chamber. The cover 59 can have a wedge-like shape that is generally pointed toward the rear of the food storage chamber. In FIG. 9, the cover 59 is shown in its attached position within a food storage chamber, snapped into the housing and covering the housing and the opening in which the housing is located.

In an embodiment, the housing 71 is placed within the opening or aperture 73 through the liner 19 (see FIG. 7). Subsequently, insulating foam (not shown) is applied around the housing and liner 19 to insulate the food storage chamber.

Turning to FIGS. 10 and 11, shown are portions of the inner liner 21 for the freezer storage chamber 15. A plurality of lighting devices 41 are shown mounted to sidewalls 25, 27 of the inner liner 21. The lighting devices 41 illuminate the freezer storage chamber 15 when the door 31 (see FIG. 1) is opened. The lighting devices 41 emit light rearward, toward the rear wall 23 (see FIG. 1) of the liner 21, in a front-to-back manner as described above. The lighting devices 41 within the freezer storage chamber 15 can provide substantially vertically uniform lighting within the freezer storage chamber at a color temperature between 4000 K and 5500 K.

It is to be appreciated that the lighting devices 41 discussed herein can be applied within the fresh food or freezer storage chamber of the side-by-side, top mount or bottom mount refrigeration appliances. The lighting devices 41 can also be applied within other refrigeration appliances, such as wine coolers upright freezers.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refrigeration appliance, comprising:

an appliance housing;

a liner within the appliance housing, defining an interior storage chamber at least partially enclosed by the liner, and providing a storage chamber rear wall, a first storage chamber sidewall, and a second storage chamber sidewall, the first storage chamber sidewall having a plurality of openings through the first storage chamber sidewall and the second storage chamber sidewall having another plurality of openings through the second storage chamber sidewall; and a plurality of lighting devices for illuminating the interior storage chamber, wherein each of the lighting devices is mounted within a respective one of the openings and emits light toward the storage chamber rear wall providing a showcase lighting effect, and wherein each of the lighting devices includes a cover located in the interior storage chamber and a device housing located within the respective one of the openings, a movable closure having an open position for providing access to the storage chamber through an access opening and a closed position for closing the access opening, wherein the plurality of openings through the first storage chamber sidewall are located closer to the access opening than to the storage chamber rear wall, and wherein the another plurality of openings through the second storage chamber sidewall are located closer to the access opening than to the storage chamber rear wall, and wherein an illumination level within the storage chamber, due to the light emitted by the plurality of lighting devices, is substantially vertically uniform.

2. The refrigeration appliance of claim 1, wherein the illumination level is substantially vertically uniform adjacent to the storage chamber rear wall.

3. The refrigeration appliance of claim 2, wherein each of the lighting devices comprises a light-emitting diode light fixture, and each light-emitting diode light fixture comprises a translucent lens, and further wherein the light emitted by the plurality of lighting devices has a color temperature between 4000 K and 5500 K.

4. A refrigeration appliance, comprising:

an appliance housing;

a liner within the appliance housing, defining an interior storage chamber at least partially enclosed by the liner, and providing a storage chamber rear wall, a first storage chamber sidewall, and a second storage chamber sidewall, the first storage chamber sidewall having a plurality of openings through the first storage chamber sidewall and the second storage chamber sidewall having another plurality of openings through the second storage chamber sidewall; and a plurality of lighting devices for illuminating the interior storage chamber, wherein each of the lighting devices is mounted within a respective one of the openings and emits light toward the storage chamber rear wall providing a showcase lighting effect, and wherein each of the lighting devices includes a cover located in the interior storage chamber and a device housing located within the respective one of the openings, and wherein an illumination level within the storage chamber, due to the light emitted by the plurality of lighting devices, is substantially vertically uniform, wherein each of the lighting devices comprises a light-emitting diode light fixture, and each light-emitting diode light fixture comprises a translucent lens, and further wherein the light emitted by the plurality of lighting devices has a color temperature between 4000 K and 5500 K, the refrigeration appliance further comprising a movable closure having an open position for providing access to the storage chamber through an access opening and a closed position for closing the access opening, wherein the plurality of openings through the first storage chamber sidewall are located closer to the access opening than to the storage chamber rear wall, and wherein the another plurality of openings through the second storage chamber sidewall are located closer to the access opening than to the storage chamber rear wall.

5. The refrigeration appliance of claim 4, wherein the storage chamber is a fresh food storage chamber, the appliance further comprising:

a freezer storage chamber located beneath the fresh food storage chamber; and a drawer for providing access to the freezer storage chamber.

6. The refrigeration appliance of claim 4, wherein each light-emitting diode light fixture includes a single light-emitting diode for illuminating the storage chamber.

7. The refrigeration appliance of claim 4, wherein the storage chamber is a fresh food storage chamber, the appliance further comprising:

a freezer storage chamber at least partially enclosed by a freezer storage chamber liner, wherein the freezer storage chamber liner includes another storage chamber rear wall, a third storage chamber sidewall having a plurality of vertically aligned openings through the third storage chamber sidewall, and a fourth storage chamber sidewall having a plurality of vertically aligned openings through the fourth storage chamber sidewall;

a movable freezer storage chamber closure closing a freezer storage chamber access opening; and another plurality of lighting devices that illuminate the freezer storage chamber providing a showcase lighting effect to the freezer storage chamber, wherein each one of the another plurality of lighting devices is mounted within a respective one of the openings through the third storage chamber sidewall and the fourth storage chamber sidewall and illuminates the freezer storage chamber with light having a color temperature between 4000 K and 5500 K, wherein an illumination level within the freezer storage chamber due to the another plurality of lighting devices is substantially vertically uniform, and wherein the plurality of openings through the first storage chamber sidewall are vertically aligned with each other, and the plurality of openings through the second storage chamber sidewall are vertically aligned with each other.

8. A refrigeration appliance, comprising:

an appliance housing;

a liner within the appliance housing, at least partially enclosing a fresh food storage chamber, and providing a rear wall, a first sidewall having a plurality of openings in a surface of the first sidewall, and a second sidewall having a plurality of openings in a surface of the second sidewall;

a plurality of light-emitting diode light fixtures that emit light toward the rear wall providing a showcase lighting effect, wherein each of the light-emitting diode light fixtures includes a fixture housing located within a respective one of the openings and a cover covering at least a portion of the respective one of the openings;

a movable closure having an open position for providing access to the fresh food storage chamber through an access opening and a closed position for closing the access opening, wherein the plurality of openings in the surface of the first sidewall and the plurality of openings in the surface of the second sidewall are located closer to the access opening than to the rear wall, and wherein an illumination level within the fresh food storage chamber, due to the light emitted by the plurality of light-emitting diode light fixtures, is substantially vertically uniform.

9. The refrigeration appliance of claim 8, wherein the illumination level is substantially vertically uniform adjacent to the rear wall.

10. The refrigeration appliance of claim 8, wherein the plurality of openings in the surface of the first sidewall comprises apertures through the first sidewall and wherein the plurality of openings in the surface of the second sidewall comprise apertures through the second sidewall.

11. The refrigeration appliance of claim 8 wherein each of the light-emitting diode light fixtures comprises a translucent lens, and wherein each of the light-emitting diode light fixtures illuminates the fresh food storage chamber with light having a color temperature between 4000 K and 5500 K.

12. The refrigeration appliance of claim 11, further comprising:

a freezer storage chamber located beneath the fresh food storage chamber; and a drawer for providing access to the freezer storage chamber.

13. The refrigeration appliance of claim 11, further comprising:

a freezer storage chamber at least partially enclosed by a freezer storage chamber liner;

a movable freezer storage chamber closure closing a freezer storage chamber access opening; and another plurality of light-emitting diode light fixtures that illuminate the freezer storage chamber and provide a showcase lighting effect to the freezer storage chamber.

14. The refrigeration appliance of claim 13, wherein the freezer storage chamber liner includes another rear wall, a third sidewall having a plurality of vertically aligned openings in a surface of the third sidewall, and a fourth sidewall having a plurality of vertically aligned openings in a surface of the fourth sidewall, wherein each one of the another plurality of light-emitting diode light fixtures that illuminate the freezer storage chamber is located within a respective one of the openings in the surfaces of the third sidewall and the fourth sidewall and illuminates the freezer storage chamber with light having a color temperature between 4000 K and 5500 K, wherein an illumination level within the freezer storage chamber due to the another plurality of light-emitting diode light fixtures is substantially vertically uniform, and wherein the plurality of openings in the surface of the first sidewall are vertically aligned with each other, and the plurality of openings in the surface of the second sidewall are vertically aligned with each other.

* * * * *